US011640806B2

(12) United States Patent
Oh et al.

(10) Patent No.: US 11,640,806 B2
(45) Date of Patent: May 2, 2023

(54) DATA DRIVING CIRCUIT, CONTROLLER AND DISPLAY DEVICE FOR REDUCING LOAD OF CIRCUITS DURING HIGH-SPEED DRIVING

(71) Applicant: LG DISPLAY CO., LTD., Seoul (KR)

(72) Inventors: Jinyoung Oh, Paju-si (KR); JaeYoon Kim, Paju-si (KR); GyuJin Bae, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/509,921

(22) Filed: Oct. 25, 2021

(65) Prior Publication Data

US 2022/0165229 A1 May 26, 2022

(30) Foreign Application Priority Data

Nov. 20, 2020 (KR) ..... 10-2020-0157034

(51) Int. Cl.
*G09G 3/36* (2006.01)
*G09G 3/3225* (2016.01)
*G09G 3/3266* (2016.01)

(52) U.S. Cl.
CPC ..... *G09G 3/3648* (2013.01); *G09G 3/3225* (2013.01); *G09G 2310/0264* (2013.01); *G09G 2310/061* (2013.01)

(58) Field of Classification Search
None
See application file for complete search history.

(56) References Cited

U.S. PATENT DOCUMENTS

2006/0291284 A1 12/2006 Han
2007/0132684 A1 6/2007 Baek et al.
2009/0273557 A1* 11/2009 Song ..... G09G 3/3648 345/87
2010/0156947 A1 6/2010 Moon et al.
2013/0286003 A1* 10/2013 Park ..... G09G 3/3685 345/214
2017/0047028 A1* 2/2017 Seo ..... G09G 3/3614
2017/0076683 A1 3/2017 Lee et al.
(Continued)

FOREIGN PATENT DOCUMENTS

CN 1979318 A 6/2007
CN 101178495 A 5/2008
(Continued)

*Primary Examiner* — Sepehr Azari
(74) *Attorney, Agent, or Firm* — Birch, Stewart, Kolasch & Birch, LLP

(57) ABSTRACT

Embodiments of the present disclosure relate to a data driving circuit, a controller and a display device. A display driving is performed by outputting the number of internal data enable signals that is smaller than the number of external data enable signals in the display device performing high-speed driving. As a result, it is possible to prevent an increase in the load of the data driving circuit according to the high-speed driving. In addition, a part of the internal data enable signals is output during a blank period to prevent a decrease in the interval between the internal data enable signals and to increase the number of internal data enable signals. This can improve the image quality displayed on the display panel while preventing an increase in the load on the data driving circuit.

17 Claims, 12 Drawing Sheets

(56) References Cited

U.S. PATENT DOCUMENTS

| | | | | |
|---|---|---|---|---|
| 2020/0243008 | A1* | 7/2020 | Lee | H01L 29/7869 |
| 2022/0084450 | A1* | 3/2022 | Kim | G09G 3/20 |

FOREIGN PATENT DOCUMENTS

| | | | |
|---|---|---|---|
| CN | 101783837 | A | 6/2010 |
| CN | 106104664 | A | 11/2016 |
| JP | 5374218 | B1 | 8/2016 |

* cited by examiner

DATA DRIVING CIRCUIT, CONTROLLER AND DISPLAY DEVICE FOR REDUCING LOAD OF CIRCUITS DURING HIGH-SPEED DRIVING

CROSS REFERENCE TO RELATED APPLICATION

This application claims priority to Korean Patent Application No. 10-2020-0157034, filed on Nov. 20, 2020 in the Republic of Korea, the entire contents of which are hereby expressly incorporated by reference for all purposes as if fully set forth herein into the present application.

BACKGROUND

Field

The present disclosure relates to a data driving circuit, a controller and a display device.

Description of Related Art

The growth of the information society leads to an increased demand for display devices to display images and the use of various types of display devices, such as liquid crystal display devices, organic light emitting display devices, etc.

A display device can include a display panel in which a plurality of gate lines, a plurality of data lines, and a plurality of subpixels are disposed, and various driving circuits and a controller for driving the display panel.

The display device can display an image by driving the plurality of gate lines and the plurality of data lines during one frame period and controlling the brightness of a plurality of subpixels.

As the driving frequency of the display device increases, the number of frames for displaying images per unit time increases, so that a smoother image display is possible and an excellent image quality can be provided.

On the other hand, as the driving frequency of the display device increases, there may occur limitations due to the heat generation of the driving circuit and increase in power consumption. In addition, as the amount of computation increases for high-speed driving, there is a limitation in that the size of the controller for controlling the driving circuit may increase.

SUMMARY OF THE DISCLOSURE

Embodiments of the present disclosure can provide a method capable of preventing an increase in the temperature and power consumption of a data driving circuit included in a display device driven at a high speed with a high driving frequency and an increase in the size of the controller.

Embodiments of the present disclosure can provide a method capable of reducing the load of the data driving circuit and the amount of calculation of the controller when driving the display device at high speed, and capable of preventing the deterioration of the image quality of the image displayed through the display panel.

In one aspect, embodiments of the present disclosure can provide a display device including a display panel in which a plurality of gate lines, a plurality of data lines, and a plurality of subpixels are disposed, a data driving circuit for supplying a data voltage to the plurality of data lines, and a controller for controlling the data driving circuit.

The controller can receive a plurality of external data enable signals from outside and output a plurality of internal data enable signals to the data driving circuit.

At least one of the number of times and an interval at which the plurality of internal data enable signals are output during one frame period can be different from a corresponding at least one of the number of times and an interval at which the plurality of external data enable signals are input during the one frame period.

During the one frame period, the number of times at which the plurality of internal data enable signals are output can be smaller than the number of times at which the plurality of external data enable signals are input.

During the one frame period, the interval at which the plurality of internal data enable signals are output can be greater than the interval at which the plurality of external data enable signals are input.

At least one of the plurality of internal data enable signals can be output in a blank period included in the one frame period. A scan signal can be supplied to at least one of the plurality of gate lines in response to at least one internal data enable signal output in the blank period.

In another aspect, in a display device according to embodiments of the present disclosure, during one frame period within a period in which the display panel is driven at a first driving frequency, the number of times and an interval at which the plurality of internal data enable signals are output can be the same as the number of times and an interval at which the plurality of external data enable signals are input, respectively. In addition, during one frame period within a period in which the display panel is driven at a second driving frequency, at least one of the number of times and an interval at which the plurality of internal data enable signals are output can be different from a corresponding at least one one of the number of times and an interval at which the plurality of external data enable signals are input.

In this case, the second driving frequency can be greater than the first driving frequency.

In another aspect, embodiments of the present disclosure can provide a data driving circuit for receiving a plurality of internal data enable signals and outputting a data voltage during one frame period, wherein the data driving circuit outputs the data voltage in response to each of the plurality of internal data enable signals, and at least one of the plurality of internal data enable signals is input in a blank period of the one frame period.

In another aspect, embodiments of the present disclosure can provide a controller for receiving a plurality of external data enable signals from outside and outputting a plurality of internal data enable signals to a data driving circuit, wherein at least one of the number of times and an interval at which the plurality of internal data enable signals are output during one frame period is different from a corresponding at least one of the number of times and an interval at which the plurality of external data enable signals are input during the one frame period.

According to embodiments of the present disclosure, an image is displayed while reducing the number of scans of a data driving circuit during high-speed driving of a display device, so that it is possible to reduce an increase in the load of the data driving circuit and an increase in the amount of computation of a controller due to the high-speed driving of the display device.

According to embodiments of the present disclosure, a scanning method of the data driving circuit can be changed depending on the characteristics of the displayed image, so that it is possible to maintain image quality according to high-speed driving of the display device while reducing the number of scans of the data driving circuit.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
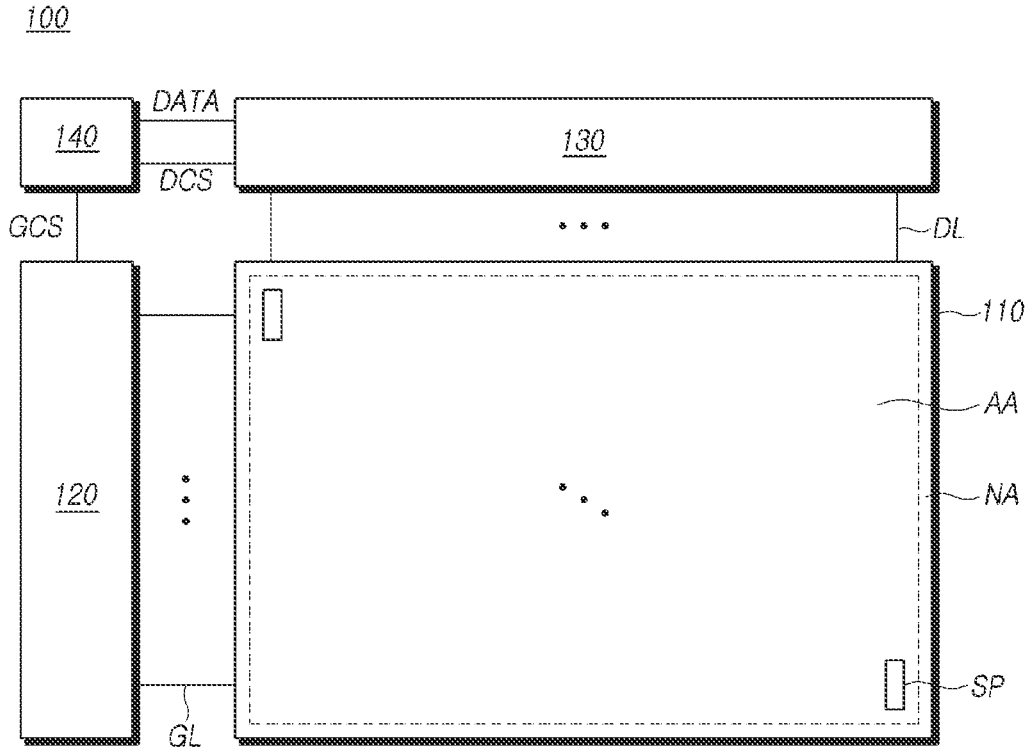
FIG. 1 schematically illustrates a configuration of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description can make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" can be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element can be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms can be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that can be caused by various factors (e.g., process factors, internal or external impact, noise, etc.) even when a relevant description is not specified. Further, the term "may" fully encompasses all the meanings of the term "can".

FIG. 1 schematically illustrates a configuration included in a display device 100 according to embodiments of the present disclosure. All the components of each display device according to all embodiments of the present disclosure are operatively coupled and configured.

Referring to FIG. 1, the display device 100 can include a display panel 110, and a gate driving circuit 120, a data driving circuit 130 and a controller 140 for driving the display panel 110.

The display panel 110 can include an active area AA in which a plurality of subpixels SP are disposed, and a non-active area NA positioned outside the active area AA.

A plurality of gate lines GL and a plurality of data lines DL can be disposed on the display panel 110. Each subpixel SP can be positioned in a region where one gate line GL and a corresponding data line DL intersect.

The gate driving circuit 120 is controlled by the controller 140. The gate driving circuit 120 can sequentially output scan signals to the plurality of gate lines GL arranged on the display panel 110, thereby controlling the driving timing of the plurality of subpixels SP.

The gate driving circuit 120 can include one or more gate driver integrated circuits GDIC. The gate driving circuit 120 can be located only at one side of the display panel 110, or can be located at both sides thereof according to a driving method.

Each gate driver integrated circuit GDIC can be connected to a bonding pad of the display panel 110 by a tape automated bonding (TAB) method or a chip-on-glass (COG) method. Alternatively, each gate driver integrated circuit GDIC can be implemented as a gate-in-panel (GIP) type and disposed directly on the display panel 110. Alternatively, each gate driver integrated circuit GDIC can be integrated and disposed on the display panel 110 in some cases. Alternatively, each gate driver integrated circuit GDIC can be implemented in a chip-on-film (COF) method to be mounted on a film connected to the display panel 110.

The data driving circuit 130 can receive data signal from the controller 140 and converts the data signal into an analog data voltage Vdata. The data driving circuit 130 outputs the data voltage Vdata to each data line DL according to the timing at which the scan signal is applied through the gate line GL so that each of the plurality of subpixels SP emits light having brightness according to the data signal.

The data driving circuit 130 can include one or more source driver integrated circuits SDIC.

Each source driver integrated circuit SDIC can include a shift register, a latch circuit, a digital-to-analog converter, an output buffer, and the like.

Each source driver integrated circuit SDIC can be connected to a bonding pad of the display panel 110 by a tape automated bonding (TAB) method or a chip-on-glass (COG) method. Alternatively, each source driver integrated circuit SDIC can be disposed directly on the display panel 110. Alternatively, each source driver integrated circuit SDIC can be integrated and disposed on the display panel 110 in some cases. Alternatively, each source driver integrated circuit SDIC can be implemented in a chip-on-film (COF) manner. In this case, each source driver integrated circuit SDIC can be mounted on a film connected to the display panel 110, and can be electrically connected to the display panel 110 through lines on the film.

The controller 140 can supply various control signals to the gate driving circuit 120 and the data driving circuit 130, and control the operation of the gate driving circuit 120 and the data driving circuit 130.

The controller 140 can be mounted on a printed circuit board or a flexible printed circuit. The controller 140 can be electrically connected to the gate driving circuit 120 and the data driving circuit 130 through a printed circuit board or a flexible printed circuit.

The controller 140 can control the gate driving circuit 120 to output a scan signal according to timing implemented in each frame. The controller 140 can convert externally received image data to match a signal format used by the data driving circuit 130, and output the converted data signal DATA to the data driving circuit 130.

The controller 140 can receive various timing signals including a vertical synchronization signal VSYNC, a horizontal synchronization signal HSYNC, an input data enable signal DE, a clock signal CLK from the outside (e.g., host system).

The controller 140 can generate various control signals by using various timing signals received from the outside, and can output the control signals to the gate driving circuit 120 and the data driving circuit 130.

For example, in order to control the gate driving circuit 120, the controller 140 can output various gate control signals GCS including a gate start pulse GSP, a gate shift clock GSC, and a gate output enable signal GOE.

Here, the gate start pulse GSP controls operation start timing of one or more gate driver integrated circuits GDIC constituting the gate driving circuit 120. The gate shift clock GSC, which is a clock signal commonly input to one or more gate driver integrated circuits GDIC, controls the shift timing of a scan signal. The gate output enable signal GOE specifies timing information on one or more gate driver integrated circuits GDIC.

In addition, in order to control the data driving circuit 130, the controller 140 can output various data control signals DCS including a source start pulse SSP, a source sampling clock SSC, a source output enable signal SOE, or the like.

Here, the source start pulse SSP controls a data sampling start timing of one or more source driver integrated circuits SDIC constituting the data driving circuit 130. The source sampling clock SSC is a clock signal for controlling the timing of sampling data in the respective source driver integrated circuits SDIC. The source output enable signal SOE controls the output timing of the data driving circuit 130.

The display device 100 can further include a power management integrated circuit for supplying various voltages or currents to the display panel 110, the gate driving circuit 120, the data driving circuit 130, and the like or controlling various voltages or currents to be supplied thereto.

Each subpixel SP can be a region defined by the intersection of the gate line GL and the data line DL, in which at least one circuit element including a light emitting device can be disposed.

For example, in the case that the display device 100 is a liquid crystal display device, the display panel 110 can include a liquid crystal layer. In addition, the arrangement of the liquid crystal can be adjusted according to the electric field formed by each of the plurality of subpixels SP, the brightness of the subpixels SP can be adjusted, and an image can be displayed.

As another example, in the case that the display device 100 is an organic light emitting display device, an organic light emitting diode OLED and various circuit elements can be disposed in the plurality of subpixels SP. The display device 100 controls the current supplied to the organic light emitting diode OLED disposed in the subpixel SP by driving several circuit elements, so that each subpixel SP can be controlled to display brightness corresponding to image data.

Alternatively, in some cases, a light emitting diode LED or a micro light emitting diode μLED can be disposed in the subpixel SP.

Figure 2:
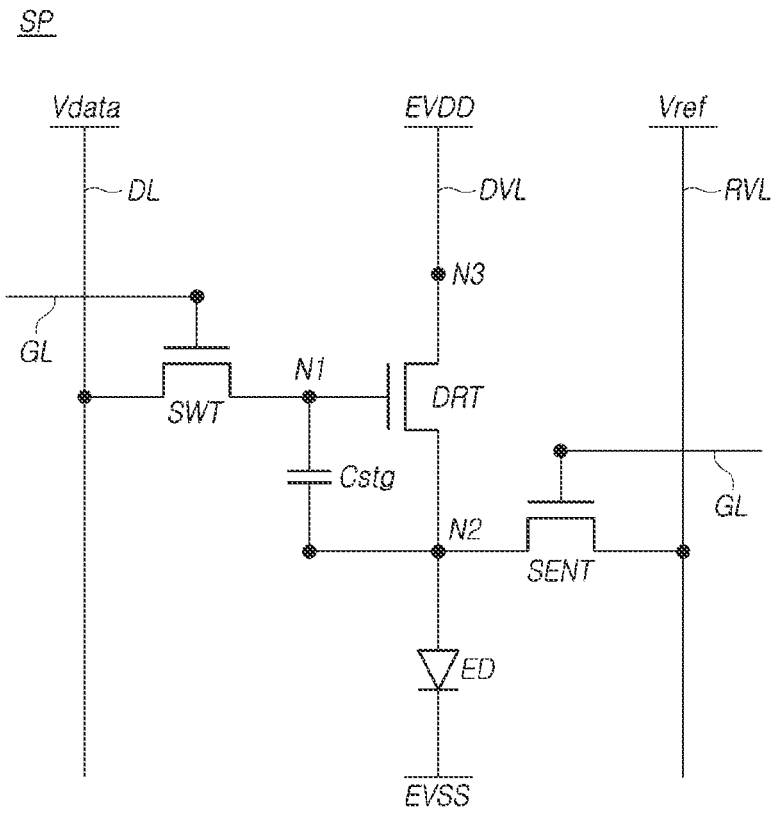
FIG. 2 illustrates an example of a circuit structure of a subpixel included in a display device according to embodiments of the present disclosure.

FIG. 2 illustrates an example of a circuit structure of the subpixel SP included in the display device 100 according to embodiments of the present disclosure. That is, each subpixel SP of FIG. 1 can have the circuit structure of FIG. 2.

Particularly, FIG. 2 illustrates an example of a circuit structure of a subpixel SP in the case that the display device 100 is an organic light emitting display device, however, embodiments of the present disclosure can be applied to other types of display devices.

Referring to FIG. 2, there can be disposed a light emitting device ED and a driving transistor DRT for driving the light emitting device ED in each of the plurality of subpixels SP. In addition, at least one circuit element other than the light emitting device ED and the driving transistor DRT can be further disposed in the subpixel SP.

For example, as illustrated in FIG. 2, a switching transistor SWT, a sensing transistor SENT, and a storage capacitor Cstg can be further disposed in the subpixel SP.

Accordingly, the example shown in FIG. 2 illustrates a 3T1C structure in which three thin film transistors and one capacitor (3T1C) are disposed in the subpixel SP in addition to the light emitting device ED as an example, but embodiments of the present disclosure are not limited thereto. Also, the example of FIG. 2 illustrates a case in which the thin film transistors are all N-type, but in some cases, the thin film transistors disposed in the subpixel SP can be P-type.

The switching transistor SWT can be electrically connected between a data line DL and a first node N1.

The data voltage Vdata can be supplied to the subpixel SP through the data line DL. The first node N1 can be a gate node of the driving transistor DRT.

The switching transistor SWT can be controlled by a scan signal supplied to the gate line GL. The switching transistor SWT can control that the data voltage Vdata supplied through the data line DL is applied to the gate node of the driving transistor DRT.

The driving transistor DRT can be electrically connected between a driving voltage line DVL and the light emitting device ED.

A first driving voltage EVDD can be supplied to a third node N3 of the driving transistor DRT through the driving voltage line DVL. The first driving voltage EVDD can be a high potential driving voltage. The third node N3 can be a drain node or a source node of the driving transistor DRT.

The driving transistor DRT can be controlled by a voltage applied to the first node N1. In addition, the driving transistor DRT can control the driving current supplied to the light emitting device ED.

The sensing transistor SENT can be electrically connected between a reference voltage line RVL and a second node N2.

A reference voltage Vref can be supplied to the second node N2 through the reference voltage line RVL. The second node N2 can be a source node or a drain node of the driving transistor DRT.

The sensing transistor SENT can be controlled by a scan signal supplied to the gate line GL. The gate line GL controlling the sensing transistor SENT can be the same as or different from the gate line GL controlling the switching transistor SWT.

The sensing transistor SENT can control that the reference voltage Vref is applied to the second node N2. Also, in some cases, the sensing transistor SENT can control the sensing of the voltage of the second node N2 through the reference voltage line RVL.

The storage capacitor Cstg can be electrically connected between the first node N1 and the second node N2. The storage capacitor Cstg can maintain the data voltage Vdata applied to the first node N1 for one frame.

The light emitting device ED can be electrically connected between the second node N2 and a line to which a second driving voltage EVSS is supplied. The second driving voltage EVSS can be a low potential driving voltage.

The light emitting device ED can express brightness according to a driving current supplied through the driving transistor DRT.

As described above, the display device 100 can display an image by controlling the driving of the plurality of subpixels SP disposed on the display panel 110. In order to improve the quality of an image displayed through the display panel 110, the display device 100 can be driven at a high driving frequency.

In the case that the display device 100 is driven at a high driving frequency, the image quality can be improved, however, there can be problems such as an increase in the load of the data driving circuit 130 for driving the display panel 110 or an increase in the size of the controller 140.

In the embodiments of the present disclosure, the scanning method of the data driving circuit 130 included in the display device 100 can vary according to the image displayed by the display panel 110. Accordingly, there can provide a method capable of reducing an increase in the load of the data driving circuit 130 included in the display device 100 or an increase in the size of the controller 140, thereby enabling the high-speed driving of the display device 100.

For example, the data driving circuit 130 included in the display device 100 can vary the number of times the data voltage Vdata output during one frame period according to an input image.

In addition, the controller 140 can control to vary the number of times the data driving circuit 130 outputs the data voltage Vdata during one frame period.

When the controller 140 receives image data and various control signals from the outside, the controller analyzes the image, and controls the data driving circuit 130 and the gate driving circuit 120 differently according to the analyzed image, so that it is possible to maintain a constant level of image quality and reduce the load of the data driving circuit 130.

In addition, it is possible to prevent an increase in the size of the controller 140 by reducing the amount of computation needed for the controller 140 to process data.

Figure 3:
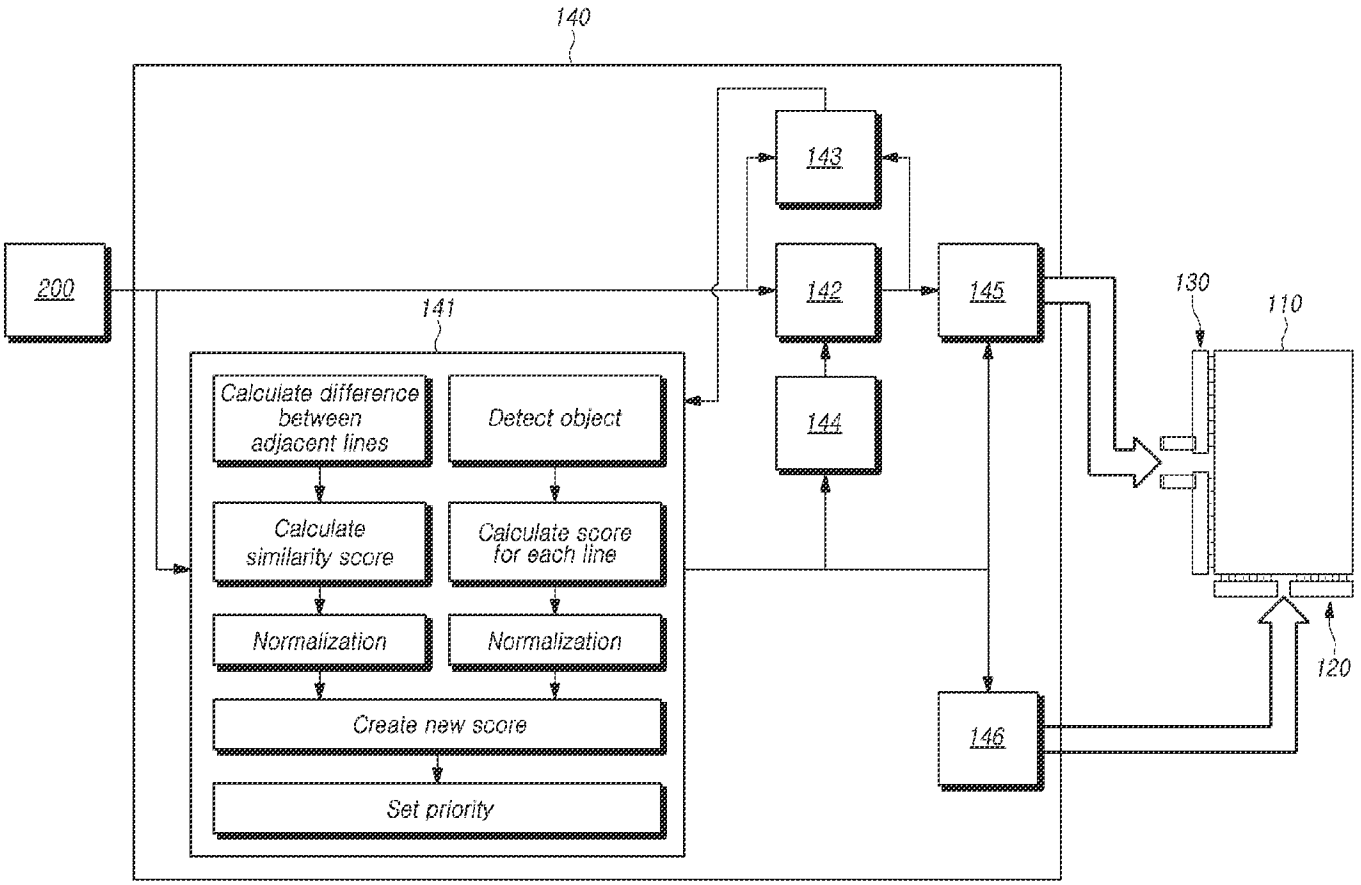
FIG. 3 schematically illustrates an example of a configuration of a controller included in a display device according to embodiments of the present disclosure.

FIG. 3 schematically illustrates an example of a configuration of a controller 140 included in a display device 100 according to embodiments of the present disclosure.

Referring to FIG. 3, the controller 140 can include, for example, an analysis unit 141, a frame memory 142, a still image determination unit 143, a frame memory control unit 144, a data processing unit 145, and a gate control unit 146.

The controller 140 can receive image data and various control signals from a host system 200.

The analysis unit 141 of the controller 140 can analyze an image based on image data received from the host system 200 and control a driving method for displaying the image in each frame.

For example, the analysis unit 141 can control the driving method of the image differently depending on whether the image according to the image data is a still image or a moving image. As another example, the analysis unit 141 can control the driving method of the image differently depending on a foreground region in which an object is displayed and a background region other than the foreground region in the image.

The frame memory 142 can store image data input from the host system 200.

The still image determination unit 143 can compare the input/output data of the frame memory 142 and determine the still image.

The frame memory control unit 144 can control the frame memory 142 according to the analysis result of the analysis unit 141. Data read by the data processing unit 145 from the frame memory 142 can be changed according to the control of the frame memory control unit 144.

The data processing unit 145 can output a data signal converted from image data and various control signals to the data driving circuit 130 according to the analysis result of the analysis unit 141.

The gate control unit 146 can control the gate driving circuit 120 according to the analysis result of the analysis unit 141.

The gate control unit 146 can be controlled so that the gate driving circuit 120 outputs a scan signal in accordance with the method in which the data driving circuit 130 supplies the data voltage Vdata according to the output signal of the data processing unit 145.

Here, the analysis unit 141 of the controller 140 can analyze the input image and reduce the number of times the data driving circuit 130 outputs the data voltage Vdata during one frame period according to the characteristics of the image.

The analysis unit 141 can reduce the load of the data driving circuit 130 by reducing the number of times the data voltage Vdata is output by the data driving circuit 130 without degrading the image quality.

Even when the display device 100 is driven at a high speed such as 120 Hz or 240 Hz, for example, the number of times of outputting the data voltage Vdata of the data driving circuit 130 can be reduced, thereby reducing the load.

Also, even if the length of the frame period is shortened due to high-speed driving, there can improve the charging rate of the display panel 110 by reducing the number of times of outputting the data voltage Vdata.

The analysis unit 141, for example, can determine whether to decrease the number of times of outputting the data voltage Vdata according to whether the input image data is a still image. If the image data is a still image, the number of times of outputting the data voltage Vdata can be reduced by driving only some gate lines GL and supplying the data voltage Vdata in each frame.

As another example, the analyzer 141 can adjust the number of times of outputting the data voltage Vdata during each frame period in consideration of the similarity of adjacent lines, an area in which an object is disposed, and the like.

The analysis unit 141 can calculate a difference between adjacent lines and calculate a similarity score. The analysis unit 141 can normalize the calculated similarity score.

The analysis unit 141 can detect an object. For example, the analysis unit 141 can detect an object by applying a high weight to a central region of the image, a region corresponding to a human skin color, or a bright region in the image data. The analysis unit 141 can detect an object and calculate a score for each line. The analysis unit 141 can normalize the calculated score for each line.

The analysis unit 141 can create a new score by synthesizing the normalized similarity score.

The analysis unit 141 can set a priority according to the created new score.

The analysis unit 141 can determine a driving method for displaying an image for each region according to priority.

For example, if the similarity of images displayed on adjacent lines is high and the priority is low as a still image, the analysis unit 141 can drive only some lines or drive a plurality of lines simultaneously.

The driving of some lines can mean driving only some gate lines GL and supplying the data voltage Vdata during one frame period.

The simultaneous driving of the plurality of lines can mean driving two or more gate lines GL at the same time and supplying the data voltage Vdata.

The analysis unit 141 can individually drive each line for a high-priority region. The individual driving of each line can mean, e.g., driving one gate line GL and supplying the data voltage Vdata.

According to the analysis result of the analysis unit 141, the number of times the data voltage Vdata is supplied during one frame period can be adjusted, so that it is possible to reduce the load of the data driving circuit 130 in the display device 100 performing high-speed driving.

In addition, by varying the driving method of the data driving circuit 130 according to the characteristics of the image, it is possible to prevent image quality deterioration, an increase in the load of the data driving circuit 130 and an increase in the amount of calculation of the controller 140.

Figure 4A:
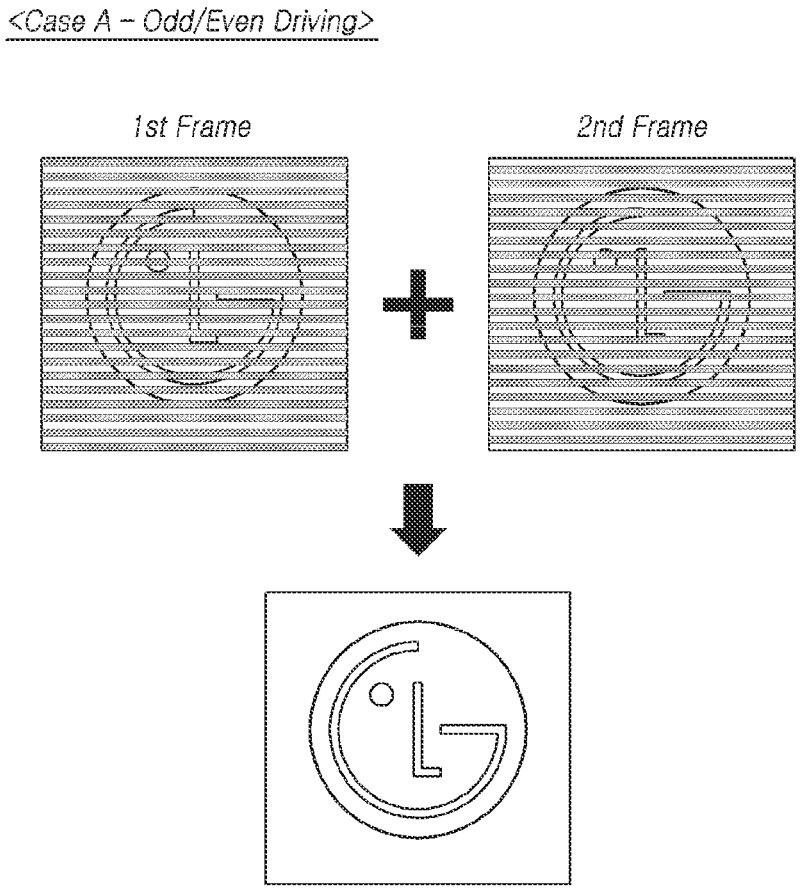
FIGS. 4A to 4C illustrate examples of displaying an image according to a driving method in the case that the display device according to embodiments of the present disclosure is driven at a high speed.
Figure 4B:
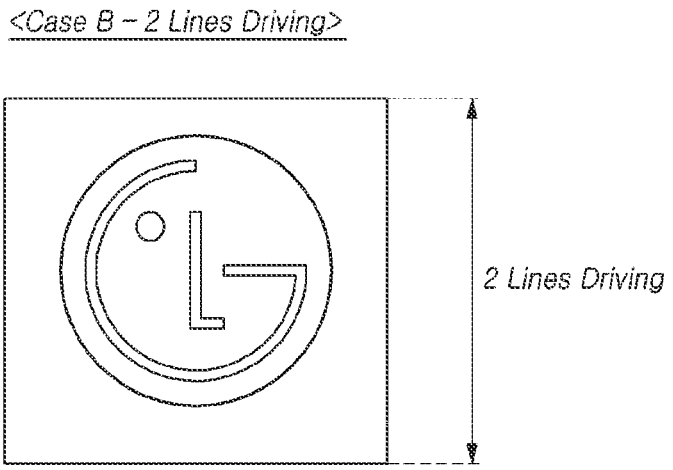
Figure 4C:
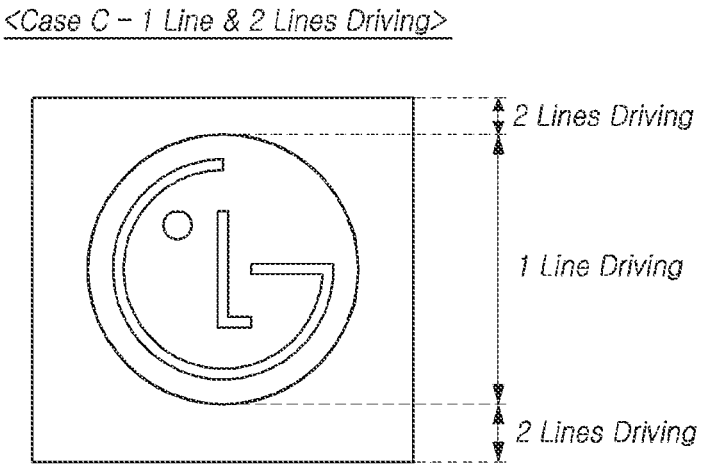

FIGS. 4A to 4C illustrate examples of displaying an image according to a driving method in the case that the display device 100 according to embodiments of the present disclosure is driven at a high speed.

Referring to FIG. 4A, when the display device 100 displays a still image, a part of lines can be driven to display the image during each frame period (Case A).

For example, the display device 100 can display an image while driving an odd-numbered line during a first frame period. In addition, the display device 100 can display an image while driving an even-numbered line during a second frame period.

The image displayed during the first frame period and the image during the second frame period can be merged and recognized as one image.

Since the display device 100 drives at high speed and displays a still image, it is possible to display an image while driving some lines during each frame period. In addition, since the number of times of outputting the data voltage Vdata in each frame period is reduced, the load of the data driving circuit 130 can be reduced.

In addition, since the number of times the gate driving circuit 120 outputs a scan signal in each frame period is also reduced, the load of the gate driving circuit 120 can also be reduced.

Referring to FIG. 4B, when the display device 100 displays a moving picture, an image can be displayed while driving all lines during each frame period (Case B).

The display device 100 drives all lines during one frame period, but can drive two or more lines with one data voltage Vdata.

As an example, a scan signal can be simultaneously supplied to two adjacent lines. The data voltage Vdata can be supplied at a timing when the scan signal is supplied to the two lines.

Here, the data voltage Vdata can be a value corresponding to an average of image data for each of two adjacent lines. Alternatively, in some cases, a weight can be applied according to the characteristics of the image data corresponding to each of the two adjacent lines, and thus the value can be within a predetermined range from the average.

It is possible to reduce the number of times of supplying the data voltage Vdata during one frame period by simultaneously driving two adjacent lines and supplying the data voltage Vdata.

If the similarity of several adjacent lines in the moving picture displayed by the display device 100 is very high, three or more lines can be simultaneously driven and the data voltage Vdata can be supplied.

Alternatively, a plurality of lines can be simultaneously driven in some areas, and one line can be driven individually in the remaining areas, based on a priority selected according to similarity for each area in the moving picture.

Referring to FIG. 4C, the display device 100 can control the driving method of the data driving circuit 130 differently for each foreground region where the object is located and for each background region other than the foreground region (Case C).

For example, in the case that the display device 100 displays an object in the center of the image, two lines can be simultaneously driven in the upper region and the lower region of the image corresponding to the background region to supply the data voltage Vdata. In addition, in the central region including the region where the object is located, one line can be individually driven to supply the data voltage Vdata.

Alternatively, in embodiments of the present disclosure, a region in which one line is driven and a region in which a plurality of lines are driven can be determined based on the similarity of images indicated by adjacent lines rather than the presence or absence of an object.

As described above, it is possible to reduce the number of times the data voltage Vdata is output by the data driving circuit 130 and prevent deterioration of image quality by differently controlling the number of lines driven for each region.

The controller 140 can differently control the driving methods of the data driving circuit 130 and the gate driving circuit 120 for each frame period according to the characteristics of the image. For example, the controller 140 can adjust the driving method of the data driving circuit 130 by varying the control signal output to the data driving circuit 130.

Figure 5:
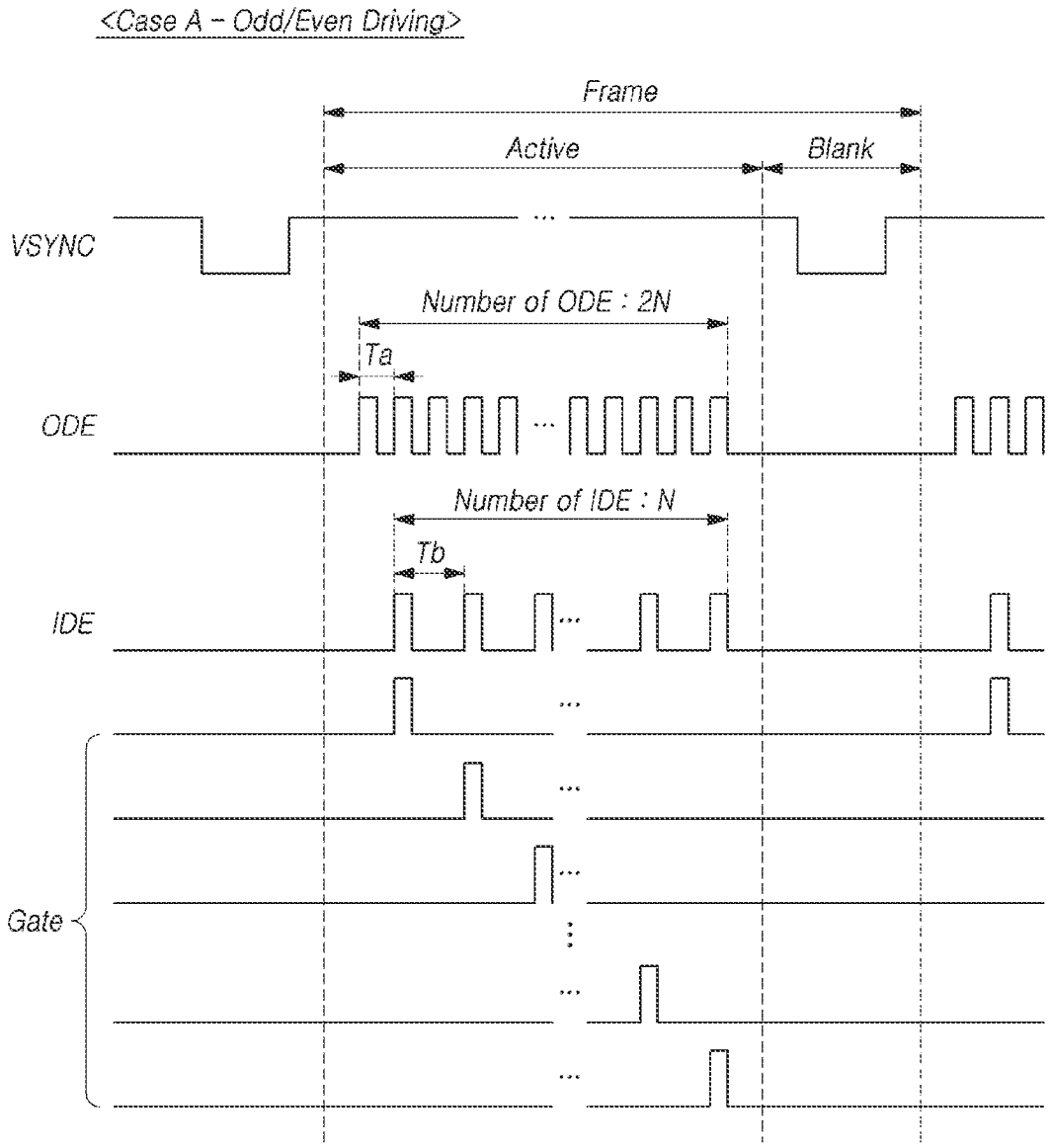
FIG. 5 illustrates an example of a signal input or output from a display device in the case that the display device is driven according to the driving method shown in FIG. 4A.

FIG. 5 illustrates an example of a signal input or output from a display device 100 in the case that the display device 100 is driven according to the driving method shown in FIG. 4A.

Referring to FIG. 5, the controller 140 can receive an external data enable signal ODE from the host system 200. The external data enable signal ODE is a signal input to the controller 140 for data output, and can refer to the above-described input data enable signal DE.

The controller 140 can output an internal data enable signal IDE to the data driving circuit 130 by using the received external data enable signal ODE. The internal data enable signal IDE is a signal for controlling the data driving circuit 130 to output the data voltage Vdata, and can refer to the above-described source output enable signal SOE.

The controller 140 can receive a plurality of external data enable signals ODEs during an active period of one frame period. In addition, the controller 140 can output a plurality of internal data enable signals IDE during the active period of one frame period.

Here, the number or interval of the external data enable signals ODE received by the controller 140 during one frame period can be different from the number or interval of the internal data enable signals IDE output by the controller 140 during one frame period.

The number or the number of times of the internal data enable signals IDE output by the controller 140 during one frame period can be smaller than the number or the number of times of the external data enable signals ODEs input during one frame period. For example, during one frame period, the controller 140 can receive 2N external data enable signals ODE and output N internal data enable signals IDE.

In addition, the interval Tb between the internal data enable signals IDE output by the controller 140 during one frame period can be greater than the interval Ta between the external data enable signals ODE input to the controller 140 during one frame period.

Since the controller 140 outputs a smaller number of internal data enable signals IDE than the number of input external data enable signals ODE, it is possible to reduce the number of times the data driving circuit 130 included in the display device 100 driven at high speed outputs the data voltage Vdata during one frame period.

In addition, since the interval between the internal data enable signals IDE increases, the charging time of the display panel 110 can increase.

One of the plurality of gate lines GL can be driven according to the timing at which the data voltage Vdata is output in accordance with the internal data enable signal IDE output by the controller 140.

For example, during one frame period, N internal data enable signals IDE, which are half of 2N which is the number of external data enable signals ODE, can be output. The odd-numbered gate lines GL among the plurality of gate lines GL can receive a scan signal in response to the internal data enable signal IDE. Here, N can be a positive number such as a positive integer.

Accordingly, the odd-numbered gate lines GL can be driven and the data voltage Vdata can be supplied during one frame period.

Then, N internal data enable signals IDE can be output during the next frame period, the even-numbered gate lines GL among the plurality of gate lines GL can be driven, and the data voltage Vdata can be supplied.

The number of times of outputs of the internal data enable signal IDE and the number of driven gate lines GL can be reduced during each frame period. Accordingly, it is possible to reduce the load of the data driving circuit 130 in the display device 100 performing high-speed driving to display an image.

Figure 6:
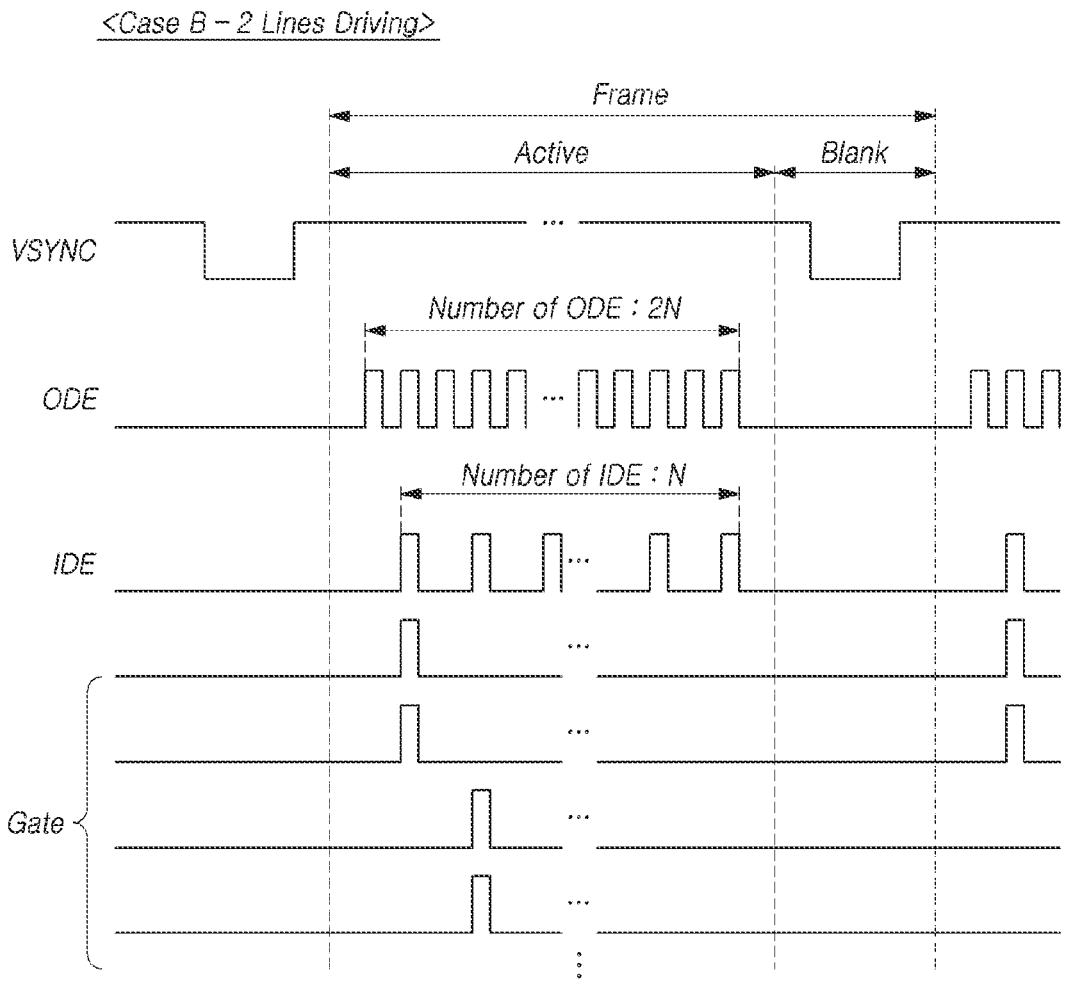
FIG. 6 illustrates an example of a signal input or output from a display device in the case that the display device is driven according to the driving method shown in FIG. 4B.

FIG. 6 illustrates an example of a signal input or output from a display device 100 in the case that the display device 100 is driven according to the driving method shown in FIG. 4B.

Referring to FIG. 6, the controller 140 can receive 2N external data enable signals ODEs from the host system 200 during one frame period.

In the case that the display device 100 performs high-speed driving, the length of one frame period can be short. Also, as the resolution increases, the number of external data enable signals ODEs input during one frame period increases, so that an interval between the external data enable signals ODEs can be small.

The controller 140 can output a smaller number of internal data enable signals IDE than the number of input external data enable signals ODEs to the data driving circuit 130 in one frame period. The interval between the internal data enable signals IDE can be greater than the interval between the external data enable signals ODE.

Two or more gate lines GL can be driven in response to each internal data enable signal IDE.

For example, two adjacent gate lines GL can be driven in response to one internal data enable signal IDE. Accordingly, the data voltage Vdata output according to the internal data enable signal IDE can be supplied to the lines driven by the two gate lines GL.

Since two adjacent lines are driven with one data voltage Vdata, the number of times of outputting the data voltage Vdata during one frame period can decrease. In addition, two adjacent lines can be simultaneously driven to display an image.

Further, the number of lines driven for each region can be adjusted depending on the image characteristics.

Figure 7:
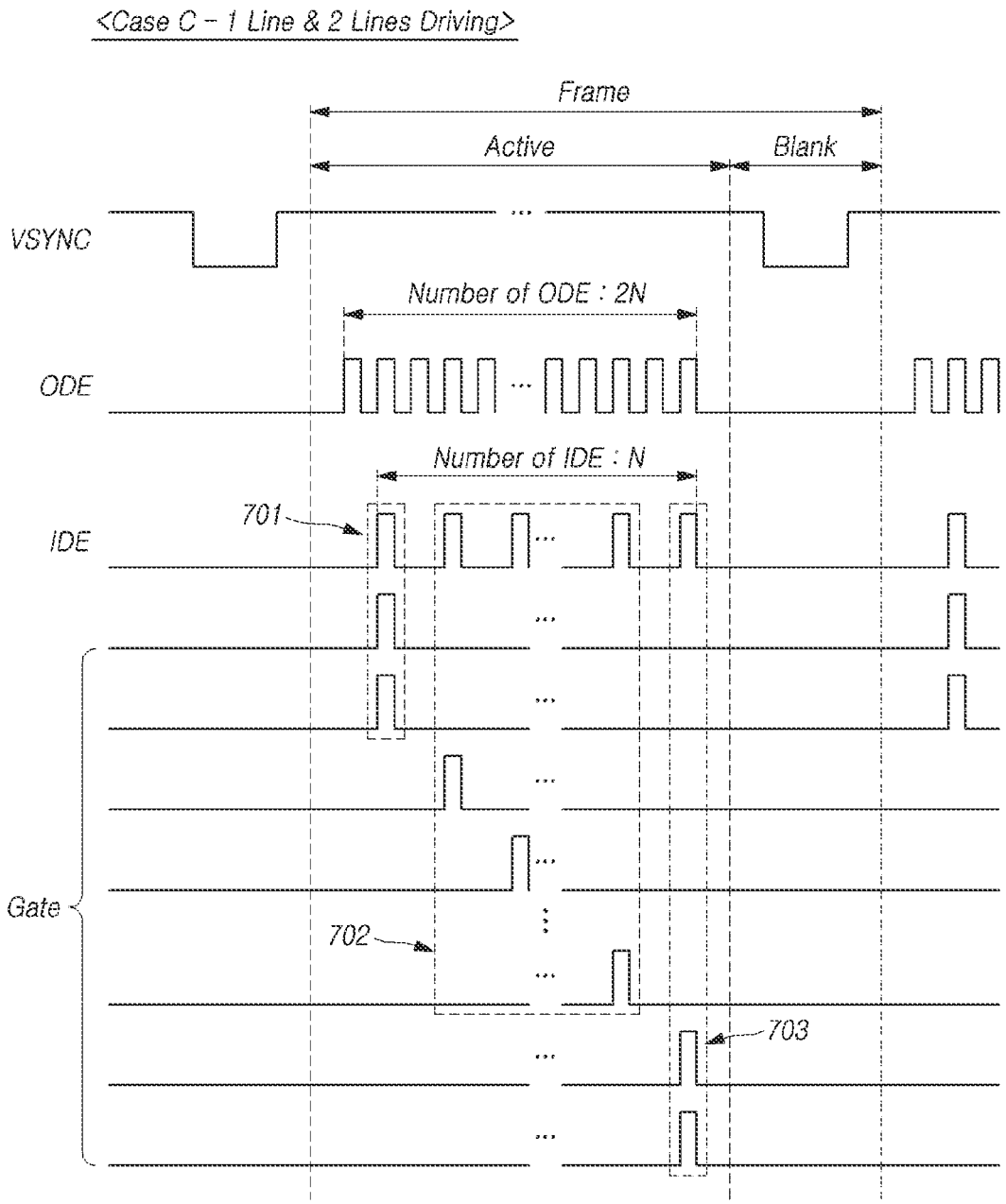
FIG. 7 illustrates an example of a signal input or output from a display device in the case that the display device is driven according to the driving method shown in FIG. 4C.

FIG. 7 illustrates an example of a signal input or output from a display device 100 in the case that the display device 100 is driven according to the driving method shown in FIG. 4C.

Referring to FIG. 7, there can be output a smaller number of internal data enable signals IDE than the number of external data enable signals ODE input in one frame period.

As indicated by 701 and 703, two gate lines GL can be driven in response to some internal data enable signals IDE among a plurality of internal data enable signals IDE.

As indicated by 702, one gate line GL can be driven in response to the rest of internal data enable signals IDE among the plurality of internal data enable signals IDE.

As described above, a region in which a plurality of lines are simultaneously driven and a region in which one line is driven can be distinguished according to the similarity of images displayed by adjacent lines or the presence or absence of an object.

Since the number of lines simultaneously driven for each region can be adjusted according to the characteristics of the image displayed by the display panel 110, it is possible to maintain image quality while reducing the number of data voltages Vdata output during one frame period.

In addition, in the case that the number of lines simultaneously driven for each region is adjusted, the number of internal data enable signals IDE needed to supply the data voltage Vdata can increase.

In this case, the number of internal data enable signals IDE output during the active period can be increased by reducing the interval between the internal data enable signals IDE.

Alternatively, some of the plurality of internal data enable signals IDE can be output during a blank period of one frame period. Accordingly, it is possible to prevent a reduction in the interval between the internal data enable signals IDE, and increase the number of internal data enable signals IDE needed to drive the display.

Figure 8:
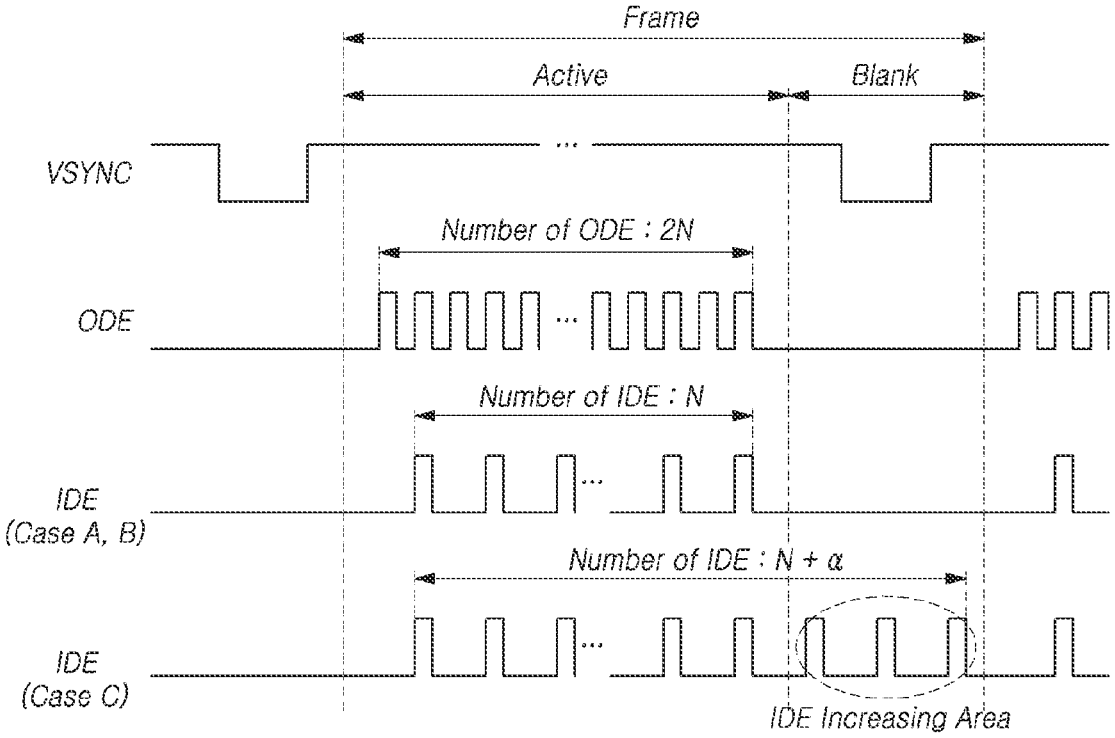
FIGS. 8 to 10 illustrate other examples of signals input or output from a display device in the case that the display device according to embodiments of the present disclosure is driven at a high speed.
Figure 9:
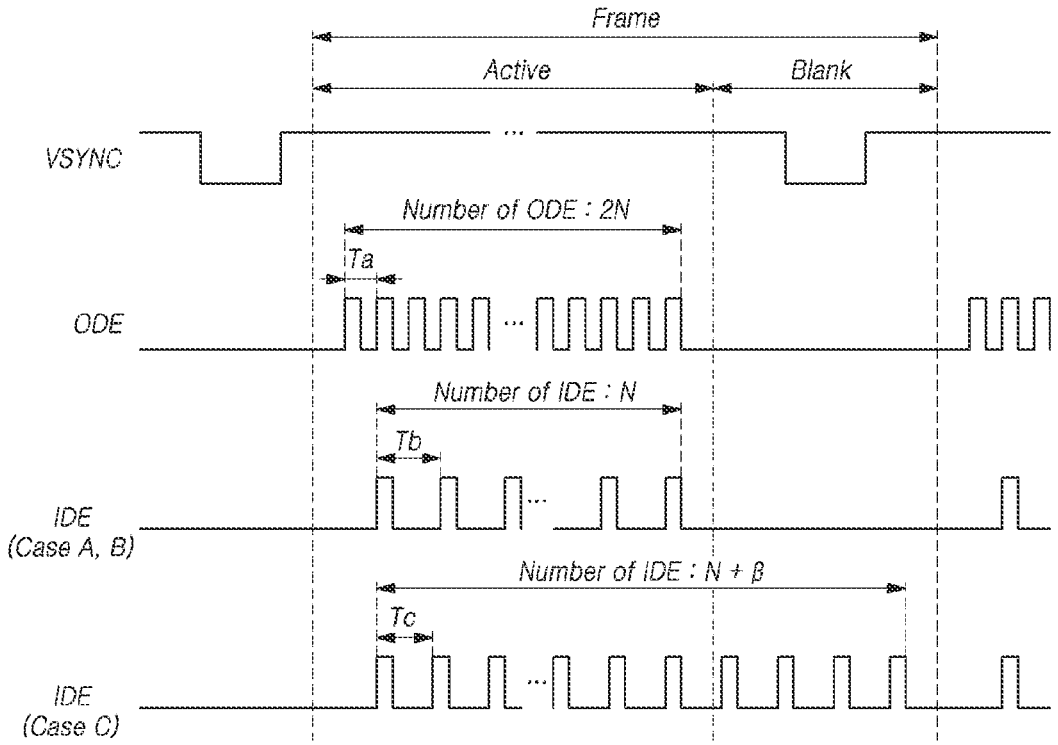
Figure 10:
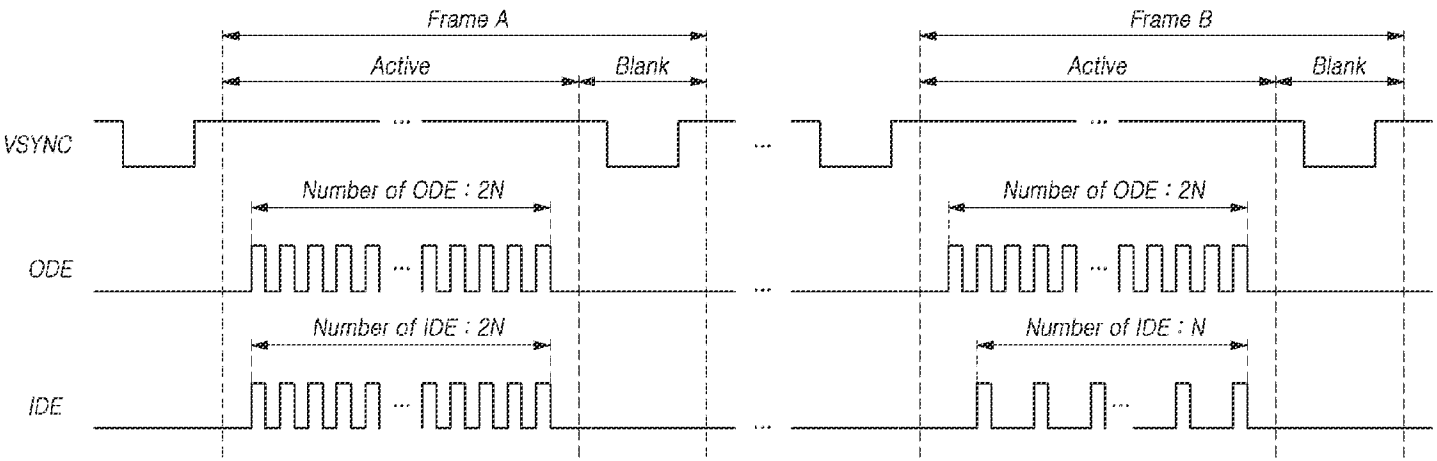

FIGS. 8 to 10 illustrate other examples of signals input or output from a display device 100 in the case that the display device 100 according to embodiments of the present disclosure is driven at a high speed.

Referring to FIG. 8, the controller 140 can receive 2N external data enable signals ODEs in one frame period. Here, N can be a positive number such as a positive integer.

In that case that the display device 100 drives only some lines during one frame period as in Case A or drives a plurality of lines in response to one internal data enable signal IDE as in Case B, the number of internal data enable signals IDE needed to output the data voltage Vdata can be N.

As in Case C, in the case that a plurality of lines are driven for some regions and a single line is driven for the remaining regions during one frame period, the number of internal data enable signals IDE needed to output the data voltage Vdata can be (N+α), where α is a value such as a number.

A part of the (N+α) internal data enable signals IDE can be output in a blank period of one frame period.

The gate line GL can be driven in response to the internal data enable signal IDE output during the blank period.

The gate line GL driven in response to one internal data enable signal IDE output during the blank period can be one, or can be two or more.

Since the internal data enable signal IDE is output during the blank period to increase the number of the internal data enable signal IDE, it is possible to prevent a reduction in the interval between the internal data enable signals IDE.

Thus, it is possible to prevent the interval at which the data voltage Vdata is outputted from decreasing while reducing the number of times the data driving circuit 130 outputs the data voltage Vdata in one frame period.

Accordingly, it is possible to reduce the load of the data driving circuit 130 and increase the charging time.

In addition, by adjusting the number of lines simultaneously driven for each region according to the characteristics of the image, it is possible to reduce an increase in the load of the data driving circuit 130 in the display device 100 performing high-speed driving, and to maintain image quality above a specific level.

Also, if it is needed an increase in the internal data enable signal IDE according to the characteristics of the image, there can reduce the interval between the internal data enable signals IDE.

Referring to FIG. 9, in the case that the controller 140 receives 2N external data enable signals ODE in one frame period, the controller 140 can output N internal data enable signals IDE in one frame period in Case A or Case B.

The load of the data driving circuit 130 can be reduced by driving the display device 100 performing high-speed driving in response to the N internal data enable signals IDE.

As in Case C, if the number of lines driven for each region is adjusted, the controller 140 can output (N+β) internal data enable signals IDE in one frame period. Here, β can be a value greater than α described with reference to FIG. 8.

In the case of adjusting the number of lines driven for each region, the number of needed internal data enable signals IDE can increase when the ratio of driving one line increases according to the characteristics of the image.

Since the period can be insufficient even if some internal data enable signals IDE are output during the blank period, the controller 140 can output the internal data enable signal IDE by reducing the interval between the internal data enable signals IDE.

As an example, the interval between the internal data enable signals IDE output by the controller 140 can be Tc. Tc can be smaller than the interval Tb between the internal data enable signals IDE output by the controller 140 in case of Case A or Case B.

Also, Tc can be greater than the interval Ta between the external data enable signals ODE input to the controller 140.

Even if the interval between the internal data enable signals IDE is reduced, since the interval between the external data enable signals ODE is larger than the interval between the internal data enable signals IDE, the charging time of the display panel 110 can increase.

One or two or more lines can be driven in response to each of the (N+β) internal data enable signals IDE, and the data voltage Vdata can be supplied according to each internal data enable signal IDE.

Further, at least one line can be driven in accordance with the internal data enable signal IDE output during the blank period, and the data driving circuit 130 can output the data voltage Vdata in accordance with the internal data enable signal IDE.

Since the number (N+β) of the internal data enable signals IDE is smaller than the number 2N of external data enable signals ODE, it is possible to reduce the number of times the data voltage Vdata is output by the data driving circuit 130 included in the display device 100 performing high-speed driving.

The supply timing of the data voltage Vdata can be secured by outputting the internal data enable signal IDE during the blank period, so that the images can be displayed according to the characteristics of the image. In addition, since the number of times of outputting the data voltage Vdata is reduced and the interval at which the data voltage Vdata is output is maintained at a predetermined level or more, there can be reduced an increase in the load of the data driving circuit 130 due to high-speed driving.

Also, embodiments of the present disclosure can be applied to a case in which the driving frequency of the display device 100 is variable when display driving is performed.

Referring to FIG. 10, the display device 100 can perform low-speed driving or high-speed driving according to the driving state or driving period of the display device 100. The low-speed driving and the high-speed driving can be relative, and the display device 100 can be driven at a first driving frequency or a second driving frequency, for example.

The display device 100 can be driven at a relatively low first driving frequency, such as 30 Hz or 60 Hz, for example.

In the case of driving at the first driving frequency, the display device 100 can perform display driving as shown in frame A of FIG. 10.

The controller 140 can receive 2N external data enable signals ODE and output 2N internal data enable signals IDE in one frame period.

Since the first driving frequency is relatively low, the length of one frame period can be relatively long.

Accordingly, the controller 140 can perform display driving while maintaining the same number of external data enable signals ODE and internal data enable signals IDE.

The display device 100 can be driven at a second driving frequency greater than the first driving frequency according to a driving state or driving period. The second driving frequency can be, for example, a relatively high frequency such as 120 Hz or 240 Hz.

In the case of driving at the second driving frequency, the display device 100 can perform display driving as shown in frame B of FIG. 10.

The controller 140 may, during one frame period, receive 2N external data enable signals ODEs and output N internal data enable signals IDE less than 2N.

Since the display driving is performed according to the N internal data enable signals IDE, there can be reduced the number of times the data driving circuit 130 outputs the data voltage Vdata in one frame period.

In addition, as in the above example, the different lines are drived for each frame or a plurality of lines are driven in response to one internal data enable signal IDE, so that it is possible to reduce the internal data enable signal IDE and maintain a constant level of image quality.

The number and interval of the internal data enable signals IDE can be adjusted according to a period of low-speed driving and a period of high-speed driving of the display device 100. Accordingly, it is possible to reduce performance degradation of the display device 100 and to perform the high-speed driving.

According to the above-described embodiments of the present disclosure, there can be adjusted the number of internal data enable signals IDE output by the controller 140 in response to the external data enable signals ODE, so that it is possible to prevent an increase in the load of the data driving circuit 130 and an increase in the amount of computation of the controller 140 during high-speed driving.

It is possible to provide a certain level of image quality by adjusting the number of lines driven in response to the internal data enable signal IDE according to the characteristics of the image.

In addition, in the case that the needed internal data enable signal IDE increases, some internal data enable signals IDE are output during the blank period, thereby performing the display driving while minimizing the decrease in the interval between the internal data enable signals IDE.

Accordingly, it is possible to maintain the image quality of the display device 100 performing high-speed driving at a certain level or higher while preventing an increase in the load of the data driving circuit 130 or an increase in the size of the controller 140 due to high-speed driving.

The above description has been presented to enable any person skilled in the art to make and use the technical idea of the present disclosure, and has been provided in the context of a particular application and its requirements. Various modifications, additions and substitutions to the described embodiments will be readily apparent to those skilled in the art, and the general principles defined herein can be applied to other embodiments and applications without departing from the spirit and scope of the present disclosure. The above description and the accompanying drawings provide an example of the technical idea of the present disclosure for illustrative purposes only. For example, the disclosed embodiments are intended to illustrate the scope of the technical idea of the present disclosure.

Thus, the scope of the present disclosure is not limited to the embodiments shown, but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A display device comprising:

a display panel in which a plurality of gate lines, a plurality of data lines, and a plurality of subpixels are disposed;

a data driving circuit configured to supply a data voltage to the plurality of data lines; and a controller configured to control the data driving circuit, wherein the controller is configured to receive a plurality of external data enable signals from outside and output a plurality of internal data enable signals to the data driving circuit, and wherein an interval between two of the plurality of internal data enable signals output during each frame period is greater than an interval between two of the plurality of external data enable signals input during the each frame period.

2. The display device of claim 1, wherein, during the each frame period, the number of times at which the plurality of internal data enable signals are output is smaller than the number of times at which the plurality of external data enable signals are input.

3. The display device of claim 1, wherein at least one of the plurality of internal data enable signals is output in a blank period included in the each frame period.

4. The display device of claim 3, wherein a scan signal is supplied to at least one of the plurality of gate lines in response to the at least one internal data enable signal output in the blank period.

5. The display device of claim 3, wherein the plurality of internal data enable signals are output in a period excluding the blank period during a first frame period, and a part of the plurality of internal data enable signals is output in the blank period during a second frame period.

6. The display device of claim 5, wherein an interval at which the plurality of internal data enable signals are output during the second frame period is smaller than an interval at which the plurality of internal data enable signals are output during the first frame period.

7. The display device of claim 6, wherein an interval at which the plurality of internal data enable signals are output during the second frame period is greater than an interval at which the plurality of external data enable signals are input during the second frame period.

8. The display device of claim 1, wherein a scan signal is supplied to one of the plurality of gate lines in response to each of the plurality of internal data enable signals, and a gate line to which the scan signal is supplied in a first frame period among consecutive frame periods is different from a gate line to which the scan signal is supplied in a second frame period.

9. The display device of claim 1, wherein a scan signal is simultaneously supplied to at least two of the plurality of gate lines in response to each of the plurality of internal data enable signals, and the at least two gate lines to which the scan signal is simultaneously supplied are located adjacent to each other.

10. The display device of claim 1, wherein, during the each frame period, a scan signal is supplied to one of the plurality of gate lines in response to a part of the plurality of internal data enable signals, and a scan signal is simultaneously supplied to two or more of the plurality of gate lines in response to the rest of the plurality of internal data enable signals.

11. A display device comprising:

a display panel in which a plurality of gate lines, a plurality of data lines, and a plurality of subpixels are disposed;

a data driving circuit configured to supply a data voltage to the plurality of data lines; and a controller configured to control the data driving circuit, wherein the controller is configured to receive a plurality of external data enable signals from outside and output a plurality of internal data enable signals to the data driving circuit, wherein, during each frame period within a period in which the display panel is driven at a first driving frequency, an interval between two of the plurality of internal data enable signals output is the same as an interval between two of the plurality of external data enable signals input, respectively, and wherein, during each frame period within a period in which the display panel is driven at a second driving frequency, an interval between two of the plurality of internal data enable signals output is greater than an interval between two of the plurality of external data enable signals input.

12. The display device of claim 11, wherein the second driving frequency is greater than the first driving frequency.

13. The display device of claim 12, wherein, during the each frame period within the period in which the display panel is driven at the second driving frequency, the number of times at which the plurality of internal data enable signals are output is smaller than the number of times at which the plurality of external data enable signals are input.

14. The display device of claim 13, wherein, during the each frame period in which the display panel is driven at the second driving frequency, at least one of the plurality of internal data enable signals is output in a blank period included in the each frame period.

15. The display device of claim 14, wherein a scan signal is supplied to at least one of the plurality of gate lines in response to the at least one internal data enable signal output in the blank period.

16. A data driving circuit for receiving a plurality of internal data enable signals and outputting a data voltage during one frame period, the data driving circuit being configured to output the data voltage in response to each of the plurality of internal data enable signals, wherein at least one of the plurality of internal data enable signals is input in a blank period of the one frame period, and wherein an interval between two of the plurality of internal data enable signals input during the one frame period is greater than an interval between two of a plurality of external data enable signals which are used for generating the plurality of internal data enable signals.

17. The data driving circuit of claim 16, wherein the number of times at which the plurality of internal data enable signals are received during one frame period is different from the number of times at which the plurality of internal data enable signals are received during another frame period.

* * * * *